US006680701B2

(12) United States Patent
Sung

(10) Patent No.: US 6,680,701 B2
(45) Date of Patent: Jan. 20, 2004

(54) DUAL FEEDING CHIP ANTENNA WITH DIVERSITY FUNCTION

(75) Inventor: Jae-Suk Sung, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/034,382

(22) Filed: Jan. 3, 2002

(65) Prior Publication Data

US 2003/0058174 A1 Mar. 27, 2003

(30) Foreign Application Priority Data

Sep. 25, 2001 (KR) ..... 2001-59332

(51) Int. Cl.[7] ..... H01Q 1/38

(52) U.S. Cl. ..... 343/700 MS; 343/895; 343/873

(58) Field of Search ..... 343/700 MS, 702, 343/846, 873, 893, 895

(56) References Cited

U.S. PATENT DOCUMENTS 5,870,066 A * 2/1999 Asakura et al. ..... 343/895
6,023,251 A * 2/2000 Koo et al. ..... 343/895
6,040,806 A * 3/2000 Kushihi et al. ..... 343/853
6,470,198 B1 * 10/2002 Kintaka et al. ..... 505/210
2002/0149521 A1 * 10/2002 Hendler et al. ..... 343/700 MS

* cited by examiner

*Primary Examiner*—Don Wong
*Assistant Examiner*—Shih-Chao Chen
(74) *Attorney, Agent, or Firm*—Lowe Hauptman Gilman & Berner LLP

(57) ABSTRACT

Disclosed herein is a dual feeding chip antenna. The dual feeding chip antenna includes a dielectric substrate. A general transmission/reception antenna component comprised of a first conductor pattern is formed on a portion of a dielectric substrate. A diversity antenna component comprised of a second conductor pattern is formed on another portion of the dielectric substrate. A first feeding terminal is formed on one end of the general transmission/reception antenna component to connect the general transmission/reception antenna component to both transmission and reception terminals. A second feeding terminal is formed on one end of the diversity antenna component to connect the diversity antenna component to the reception terminal.

29 Claims, 4 Drawing Sheets

DUAL FEEDING CHIP ANTENNA WITH DIVERSITY FUNCTION

BACKGROUND OF THE INVENTION

1. Field of the Invention

The present invention relates generally to a dual feeding chip antenna, and more particularly to a dual feeding chip antenna that is capable of performing both a general transmission/reception function and a diversity function for improving the sensitivity of reception.

2. Description of the Prior Art

In general, for mobile communication terminals, the characteristics of radio waves may be changed depending on the movement of a user. That is, multiple waves are generated depending on the position of the user, so there occurs a fading phenomenon of radio waves. In order to reduce the fading phenomenon, a plurality of antenna components are employed in a mobile communication terminal. In this case, an antenna component to be added to an existing antenna component is called a diversity antenna component. Therefore, an antenna for mobile communication terminals is comprised of a general transmission/reception antenna component and a diversity antenna component.

FIG. 1*a* is a schematic view showing a conventional wireless communication terminal 10 equipped with the antenna described above.

Referring to FIG. 1*a*, the wireless communication terminal 10 is comprised of a whip antenna component 15 connected to a transmitter/receiver 12 through a matching circuit 14, and a flat antenna component 16 connected to an extra receiver 13. The whip antenna component 15 serves as an antenna component for a general transmission/reception function. The flat antenna component 16 serves as an antenna component for improving the sensitivity of reception, and is formed to have an inverted F-shape.

The above-described structure is implemented in a circuit diagram of FIG. 1*b*. That is, FIG. 1*b* is a circuit diagram of a transmitter/receiver having such a diversity function. As shown in FIG. 1*b*, the wireless communication terminal 10 comprises a first antenna component 15 for a transmission/reception function and a second antenna component 16 for a diversity function. The first antenna component 15 is connected to a duplexer 18 used to filter a transmission signal and a reception signal. The second antenna component 16 is connected to a reception terminal Rx to perform a diversity function for removing a fading phenomenon and improving the sensitivity of reception diversity.

As described in FIGS. 1*a* and 1*b*, the conventional wireless communication terminal for performing a diversity function should be provided with the extra antenna component as well as the general transmission/reception antenna component. Because of the addition of the extra antenna, there occur problems that the manufacturing costs of the wireless communication terminal are high, a mounting space for two antenna components should be secured when an interior circuit is designed, and the body of the wireless communication terminal is increased in its volume. Additionally, there occurs a design problem that the positions of the two antenna components should be precisely designed to obtain desired characteristics because the diversity antenna has different characteristics from the general transmission/reception antenna depending on its mounting positions.

SUMMARY OF THE INVENTION

Accordingly, the present invention has been made keeping in mind the above problems occurring in the prior art, and an object of the present invention is to provide a dual feeding chip antenna, which comprises a first conductor pattern for a general transmission/reception function and a second conductor pattern for a diversity function formed on a single dielectric substrate, a first feeding terminal formed on one end of the first conductor pattern to connect with transmission and reception terminals, and a second feeding terminal formed on one end of the second conductor pattern to connect with the reception terminal, thereby performing not only a general transmission/reception function but also a diversity function.

Another object of the present invention is to provide a multilayered dual feeding chip antenna, which comprises a first dielectric substrate provided with a first conductor pattern, a second dielectric substrate provided with a second conductor pattern, a first feeding terminal formed on one end of the first conductor pattern, and a second feeding terminal formed on one end of the second conductor pattern.

In order to accomplish the above object, the present invention provides a dual feeding chip antenna, comprising a dielectric substrate; a general transmission/reception antenna component comprised of a first conductor pattern, the first conductor pattern being formed on a portion of the dielectric substrate; a diversity antenna component comprised of a second conductor pattern, the second conductor pattern being formed on another portion of the dielectric substrate; a first feeding terminal formed on one end of the general transmission/reception antenna component to connect the general transmission/reception antenna component to both transmission and reception terminals; and a second feeding terminal formed on one end of the diversity antenna component to connect the diversity antenna component to the reception terminal, wherein said first and second conductor patterns are formed in different directions to have a polarization difference, whereby the antenna radiates from the first and second conductor patterns located on the portion of the dielectric.

Preferably, at least one of the first and second conductor patterns is bent at a predetermined angle at least two times or formed in a meandering line type, or the first and second conductor patterns are spaced apart from each other at a predetermined distance or formed in different directions to have a polarization difference.

In addition, the present invention provides a dual feeding chip antenna, comprising a dielectric substrate; a general transmission/reception antenna component comprised of a first conductor pattern, the first conductor pattern being formed in a portion of the dielectric substrate; a diversity antenna component comprised of a second conductor pattern, the second conductor pattern being formed in another portion of the dielectric substrate: a first feeding terminal formed on one end of the general transmission/reception antenna component to connect the general transmission/reception antenna component to both transmission and reception terminals; and a second feeding terminal formed on one end of the diversity antenna component to connect the diversity antenna component to the reception terminal, wherein said first and second conductor patterns are formed to have a polarization difference.

Preferably, the general transmission/reception antenna component and the diversity antenna component are arranged on the same plane of the interior of the dielectric substrate, at least one of the first and second conductor patterns is bent at a predetermined angle at least two times or formed in a meandering line type, or the first and second conductor patterns are spaced apart from each other at a predetermined distance, formed to have a polarization difference or formed to have different lengths.

In addition, the present invention provides a multilayered dual feeding chip antenna, comprising a dielectric substrate; a general transmission/reception antenna component comprised of a first conductor pattern, the first conductor pattern being formed on one substrate of at least two dielectric substrates; a diversity antenna component comprised of a second conductor pattern, the second conductor pattern being formed on another substrate of the dielectric substrates; a first feeding terminal formed on one end of the general transmission/reception antenna component to connect the general transmission/reception antenna component to both transmission and reception terminals; and a second feeding terminal formed on one end of the diversity antenna component to connect the diversity antenna component to the reception terminal.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
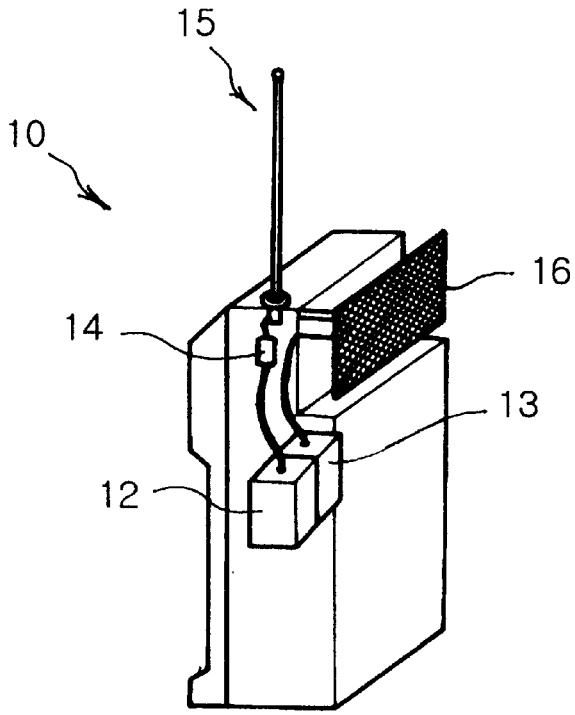
Prior Art FIG. 1a
FIG. 1*a* is a perspective view showing a conventional wireless communication terminal with a diversity reception function.
Figure 1B:
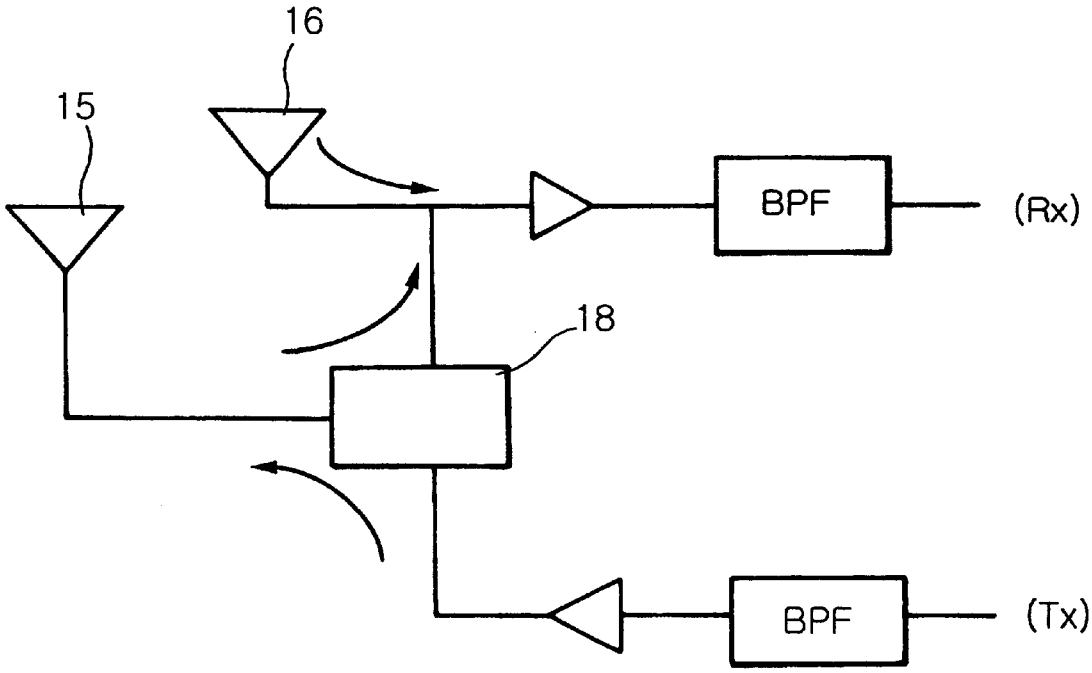
Prior Art FIG. 1b
FIG. 1*b* is a circuit diagram in which the conventional diversity reception function is implemented.

Reference now should be made to the drawings, in which the same reference numerals are used throughout the different drawings to designate the same or similar components.

Figure 2A:
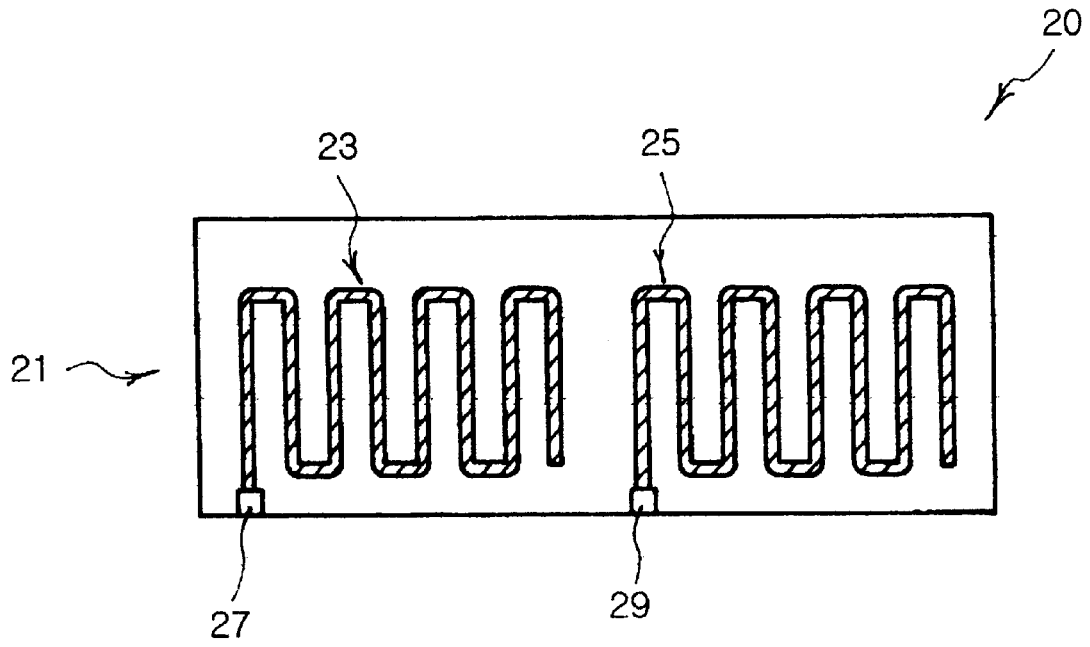
FIG. 2*a* is a schematic view showing a dual feeding antenna in accordance with a preferred embodiment of the present invention.

FIG. 2*a* is a schematic view showing a dual feeding chip antenna in accordance with a preferred embodiment of the present invention.

Referring to FIG. 2*a*, there is shown a dielectric substrate 21 on which two conductor patterns 23 and 25 are formed. In more detail, on the dielectric substrate 21, the first conductor pattern 23 for a general transmission/reception antenna component and a second conductor pattern 25 for a diversity antenna component are formed.

The conductor patterns 23, 25 are made of highly conductive metal such as Ag, Cu, Au, etc. It is preferable to form the patterns 23, 25 in a meandering line type. Additionally, it is desirable for the miniaturization of the entire antenna that the conductor patterns 23, 25 are bent at a predetermined angle at least two times each.

Meanwhile, the dual feeding chip antenna 20 of the present invention is provided at one end of the first conductor pattern 23 with a first feeding terminal 27 for connecting the first conductor pattern 23 to a transmitter/receiver, and at one end of the second conductor pattern 25 with a second feeding terminal 29 for connecting the second conductor pattern 25 to only the receiver part (not shown). In particular, the second feeding terminal 29 is connected to the receiver part, so the second conductor pattern 25 can serve as an antenna component for a diversity reception function.

Figure 2B:
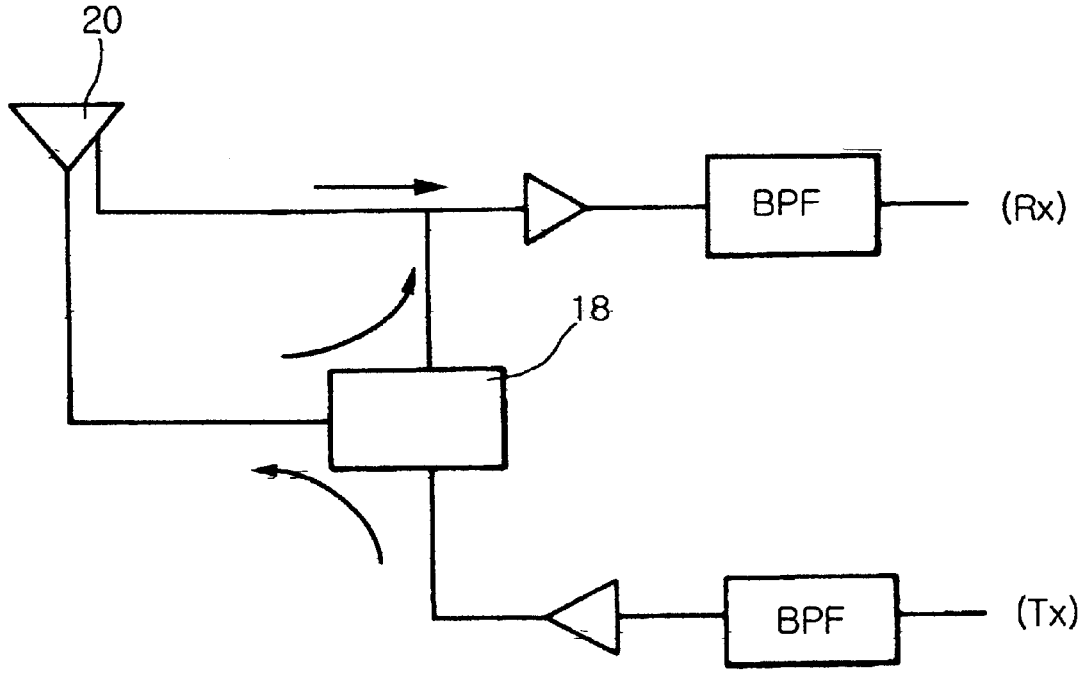
FIG. 2*b* is a circuit diagram of a dual feeding chip antenna of the present invention.

Hereinafter, with reference to FIG. 2*b*, the operation of the dual feeding chip antenna of the wireless communication terminal is described in detail. FIG. 2*b* is a diagram schematically showing a dual feeding chip antenna in accordance with the present invention.

As described above, the dual feeding chip antenna 20 consists of the two antenna components comprised of the two conductor patterns 23 and 25, respectively. The dual feeding chip antenna 20 shown in the circuit diagram is a dielectric substrate on which the first and second conductor patterns are formed.

The antenna component comprised of the first conductor pattern 23 receives radio waves outputted from a transmission terminal Tx, and transmits the radio waves to a reception terminal Rx. The antenna component comprised of the second conductor pattern 25 transmits the radio waves to the reception terminal Rx to perform a diversity function.

As a result, in the dual feeding chip antenna, the two conductor patterns 23 and 25 are formed on a single dielectric substrate 21 and the first and second feeding terminals 27 and 29 are provided to allow the two conductor patterns 23 and 25 to respectively serve as a general transmission/reception antenna and a diversity antenna, such that a general transmission/reception antenna and a diversity antenna can be integrated into a single chip antenna.

According to another feature of the present invention, desirable diversity characteristics greatly affected by the mounting positions of the general transmission/reception antenna component and the diversity antenna component can be easily implemented. The diversity characteristics become different or deteriorated depending on the mounting positions of the antenna components. Accordingly, these are serious problems in designing the interior structure of the wireless communication terminals. However, in accordance with the present invention, a single chip type antenna is implemented using conductor patterns, so the mounting position of the antenna components can be easily selected to produce desirable characteristics, thereby solving such design problems.

Differently from the above-described embodiment, first and second conductor patterns constituting a general transmission/reception antenna component and a diversity antenna component can be formed in the interior of a dielectric substrate. In this manner, a dual feeding chip antenna can be fabricated in such a way that plural green sheets are provided, the first and second conductor patterns are formed on at least one green sheet, and the plural green sheets are stacked one on top of another and baked. In the dual feeding chip antenna in which conductor patterns are formed in the interior of the dielectric substrate, desirable diversity characteristics can be easily obtained by forming various conductor patterns as described above. The technique of forming the conductor patterns in the interior of the dielectric substrate is apparent to those skilled in the art.

Hereinafter, various embodiments of dual feeding chip antennas for obtaining desirable diversity characteristics are described. In the above-described embodiment of FIG. 2*a*, a space diversity effect can be obtained by spacing two conductor patterns apart from each other.

Figure 3A:
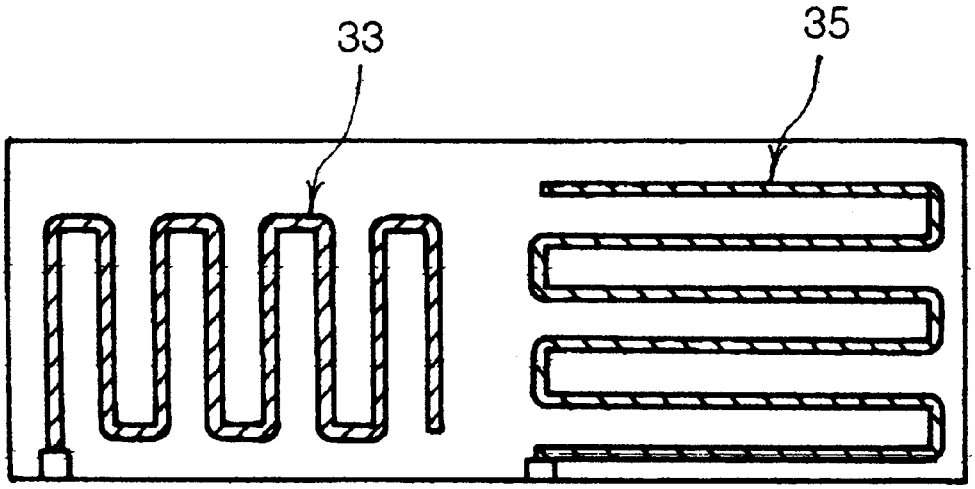
FIGS. 3*a* and 3*b* are schematic views showing dual feeding chip antennas in accordance with other embodiments of the present invention.
Figure 3B:
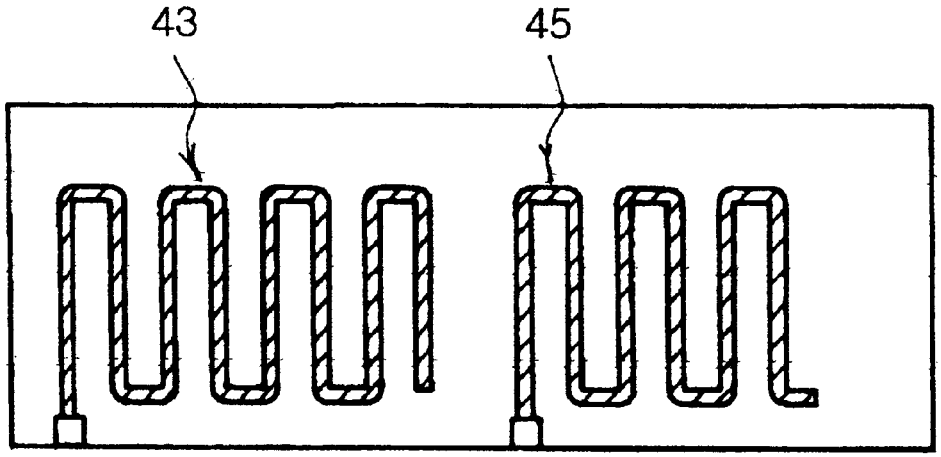

FIGS. 3*a* and 3*b* are schematic views of dual feeding chip antennas in accordance with other preferred embodiments of the present invention.

In FIG. 3*a*, a dual feeding chip antenna for various diversity functions according to another preferred embodiment is shown. In the dual feeding chip antenna shown in FIG. 3*a*, first and second conductive patterns 33 and 35 are formed to have different polarization directions. Accordingly, the second conductor pattern 35 for a diversity function receives radio waves orthogonal to radio waves received from the first conductor pattern 33, thus performing a polarization diversity function.

FIG. 3*b* is a view showing a dual feeding chip antenna for obtaining a frequency diversity effect. In this dual feeding chip antenna, the lengths of first and second conductor patterns 43 are 45 are designed to be different from each other, so resonance frequencies generated by the conductor patterns 43 and 45 become different. Referring to FIG. 2*b*, the length of the first conductor pattern 43 is greater than that of the second conductor pattern 45. Accordingly, the second conductor pattern 45 has a resonance frequency higher than the first conductor pattern 43, and can realize a frequency diversity effect using radio waves received therethrough.

As described above, the dual feeding chip antenna of the present antenna can obtain desired diversity characteristics by adjusting the relative positions of the conductor patterns formed on the dielectric substrate. As a result, in the case of a wireless communication terminal employing the above-described chip antenna, the mounting positions of two antenna components presents no problems in its design.

In the above embodiment, the dual feeding chip antenna constructed using a single dielectric substrate is described.

Differently from the above embodiment, the present invention can be applied to a multilayered dual feeding chip antenna constructed by stacking two or more dielectric substrates one on top of another in the same manner.

Figure 4:
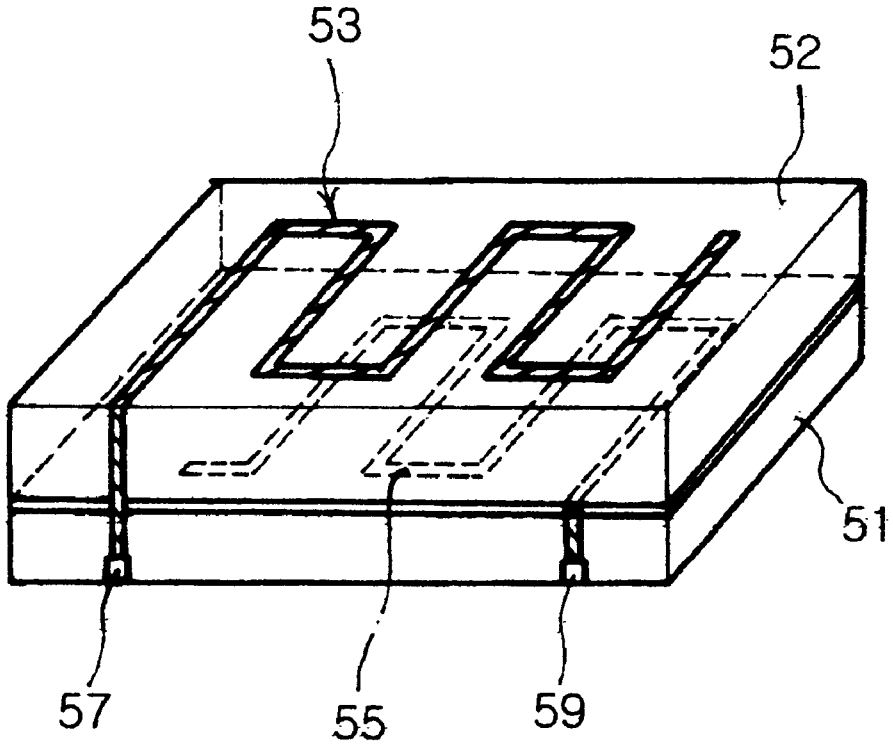
FIG. 4 is a schematic perspective view showing a multilayered dual feeding chip antenna in accordance with another embodiment of the present invention.

FIG. 4 is a schematic view showing the multilayered dual feeding antenna in accordance with the present invention.

Referring to FIG. 4, a multilayered dual feeding chip antenna 50 comprises a first dielectric substrate 52 and a second dielectric substrate 51. A first conductor pattern 53 and a second conductor pattern 55 are formed on the first dielectric substrate 52 and the second dielectric substrate 51, respectively. A first feeding terminal 57 and a second feeding terminal 59 are formed on one end of the first conductor pattern 53 and one end of the second conductor pattern 55, respectively. The first feeding terminal 57 is connected to the transmitter/receiver so that the first conductor pattern 53 can perform a general transmission/reception function, and the second feeding terminal 59 is connected to only a receiver part so that the second conductor pattern 55 can perform a diversity function. As a result, the multilayered dual feeding chip antenna also can provide the same effect as the above-described single dielectric substrate.

As described above, the present invention provides a dual feeding chip antenna, in which a general transmission/reception antenna component and a diversity antenna component are formed on or in one or more dielectric substrates using a chip antenna manufacturing technique of forming conductor patterns on or in one or more dielectric substrates, so both a general transmission/reception function and a diversity function are performed with a single chip antenna. In consequence, the complexity of a product design due to the addition of an extra antenna is solved, and the miniaturization of a product can be secured. Further, various diversity characteristics are easily obtained by adjusting the mounting positions of conductor patterns, so difficulty in designing the internal structure of a wireless communication terminal can be solved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dual feeding chip antenna, comprising:

a dielectric substrate;

a transmission/reception antenna component comprising a first conductor pattern formed on a portion of the dielectric substrate;

a diversity antenna component comprising a second conductor pattern formed on another portion of the dielectric substrate;

a first feeding terminal formed on one end of the transmission/reception antenna component and adapted to connect the transmission/reception antenna component to both transmission and reception terminals of a transmitting/receiving circuit; and a second feeding terminal formed on one end of the diversity antenna component and adapted to connect the diversity antenna component to the reception terminal;

wherein said first and second conductor patterns are oriented in different directions and said transmission/reception antenna component and said diversity antenna component have different polarization directions.

2. The dual feeding chip antenna according to claim 1, wherein at least one of said first and second conductor patterns is bent at a predetermined angle at least two times.

3. The dual feeding chip antenna according to claim 1, wherein said first and second conductor patterns are spaced apart from each other at a predetermined distance.

4. The dual feeding chip antenna according to claim 1, wherein said first and second conductor patterns are formed to have different lengths.

5. The dual feeding chip antenna according to claim 1, wherein at least one of said first and second conductor patterns is formed in a meandering line type.

6. The dual feeding chip antenna according to claim 1, wherein said first and second conductor patterns are planar meander lines.

7. The dual feeding chip antenna according to claim 6, wherein said first and second conductor patterns are coplanar.

8. The dual feeding chip antenna according to claim 6, wherein said first conductor pattern is a radiating/receiving element of said transmission/reception antenna component, and said second conductor pattern is a receiving element of said diversity antenna component.

9. The dual feeding chip antenna according to claim 6, wherein said first and second conductor patterns are electrically isolated.

10. A dual feeding chip antenna, comprising:

a dielectric substrate;

a transmission/reception antenna component comprising a first conductor pattern formed in a portion of the dielectric substrate;

a diversity antenna component comprising a second conductor pattern formed in another portion of the dielectric substrate;

a first feeding terminal formed on one end of the transmission/reception antenna component and adapted to connect the transmission/reception antenna component to both transmission and reception terminals of a transmitting/receiving circuit; and a second feeding terminal formed on one end of the diversity antenna component and adapted to connect the diversity antenna component to the reception terminal;

wherein said first and second conductor patterns have a polarization difference.

11. The dual feeding chip antenna according to claim 10, wherein said general transmission/reception antenna component and said diversity antenna component are arranged on the same plane of the interior of the dielectric substrate.

12. The dual feeding chip antenna according to claim 10, wherein at least one of said first and second conductor patterns is bent at a predetermined angle at least two times.

13. The dual feeding chip antenna according to claim 10, wherein said first and second conductor patterns are spaced apart from each other at a predetermined distance.

14. The dual feeding chip antenna according to claim 10, wherein said first and second conductor patterns are formed to have different lengths.

15. The dual feeding chip antenna according to claim 10, wherein at least one of said first and second conductor patterns is formed in a meandering line type.

16. The dual feeding chip antenna according to claim 10, wherein said first and second conductor patterns are planar meander lines.

17. The dual feeding chip antenna according to claim 11, wherein said first and second conductor patterns are entirely positioned on said plane.

18. The dual feeding chip antenna according to claim 10, wherein said first conductor pattern is a radiating/receiving element of said transmission/reception antenna component, and said second conductor pattern is a receiving element of said diversity antenna component.

19. A multilayered dual feeding chip antenna, comprising:

at least first and second dielectric substrates;

a transmission/reception antenna component comprising a radiating/receiving element which is a first conductor pattern formed on the first dielectric substrate;

a diversity antenna component comprising a receiving element which is a second conductor pattern formed on the second dielectric substrate;

a first feeding terminal formed on one end of the transmission/reception antenna component and adapted to connect the transmission/reception antenna component to both transmission and reception terminals of a transmitting/receiving circuit; and a second feeding terminal formed on one end of the diversity antenna component and adapted to connect the diversity antenna component to the reception terminal.

20. The dual feeding chip antenna according to claim 19, wherein said first and second conductor patterns are planar meander lines.

21. The dual feeding chip antenna according to claim 19, wherein an entirety of said first conductor pattern is positioned on said first substrate, and an entirety of said second conductor pattern is positioned on said second substrate.

22. The dual feeding chip antenna according to claim 21, wherein the entireties of said first and second conductor patterns are positioned in parallel planes with said first and second substrates being stacked one upon another.

23. A transmitter/receiver having a diversity function, said transmitter/receiver comprising:

a reception terminal;

a transmission terminal; and a dual feeding chip antenna comprising first and second conductor patterns configured as a transmission/reception antenna component and a diversity antenna component, respectively, and a dielectric substrate supporting said conductor patterns;

wherein said first conductor pattern has a first feeding terminal formed at one end thereof, said first feeding terminal being connected to both the transmission and reception terminals; and said second conductor pattern has a second feeding terminal formed at one end thereof said second feeding terminal being connected to the reception terminal without being connected to the transmission terminal.

24. The transmitter/receiver according to claim 23, further comprising a filter coupled between the first feeding terminal and the transmission and reception terminals, said filter filtering a transmission signal and a reception signal being transmitted to and received from said first conductor pattern, respectively.

25. The transmitter/receiver according to claim 23, wherein said first and second conductor patterns are oriented in different directions so that said transmission/reception antenna component and said diversity antenna component have different polarization directions.

26. The transmitter/receiver according to claim 23, wherein said first and second conductor patterns are planar meander lines.

27. The transmitter/receiver according to claim 26, wherein said first and second conductor patterns are coplanar.

28. The transmitter/receiver according to claim 26, wherein at least one of said first and second conductor patterns is entirely positioned within said substrate.

29. The transmitter/receiver according to claim 23, wherein each of said first and second conductor patterns is entirely positioned on a surface of said substrate.

* * * * *